United States Patent [19]

Otto

[11] 4,010,932

[45] Mar. 8, 1977

[54] MACHINE FOR MAKING AND KNEADING DOUGH

[75] Inventor: Friedrich Otto, Hameln, Germany

[73] Assignee: A. Stephan U. Sohne GmbH & Co., Hameln, Weser, Germany

[22] Filed: July 15, 1975

[21] Appl. No.: 596,081

[30] Foreign Application Priority Data

July 17, 1974 Germany ..... 2434330

[52] U.S. Cl. ..... 259/6; 259/104

[51] Int. Cl.[2] ..... B01F 7/00

[58] Field of Search ..... 259/6, 21, 41, 64, 104, 259/179, 185, 191, DIG. 8, DIG. 11, DIG. 14, DIG. 19

[56] References Cited

UNITED STATES PATENTS

| | | | |
|---|---|---|---|
| 1,518,129 | 12/1924 | Banbury | 259/6 X |
| 1,916,300 | 7/1933 | Cleveland | 259/185 |
| 2,595,373 | 5/1952 | Stewart | 324/142 X |
| 2,992,813 | 7/1961 | Bonomo et al. | 259/DIG. 8 |
| 3,150,836 | 9/1964 | Krahe | 259/6 X |
| 3,456,599 | 7/1969 | Baker | 259/191 |
| 3,648,986 | 3/1972 | Sohn | 259/104 |
| 3,751,014 | 8/1973 | Waterloo | 259/191 |

*Primary Examiner*—Edward J. McCarthy
*Attorney, Agent, or Firm*—Michael J. Striker

[57] ABSTRACT

A dough mixing and kneading machine wherein a horizontal drum has a sealable inlet opening at the top and a sealable outlet opening at the bottom. One end wall of the drum is pivotable to and from an open position and carries an L-shaped tool which sweeps along its inner side and along the internal surface of the cylindrical main section of the drum when the machine is in use. The tool is coaxial with the main section of the drum and is driven by a motor which is mounted at the outer side of the pivotable end wall. A second motor drives a shaft which extends into the drum below the axis of the main section and carries several angularly offset propellers which move the constituents of dough axially and radially of the main section.

21 Claims, 2 Drawing Figures

MACHINE FOR MAKING AND KNEADING DOUGH

BACKGROUND OF THE INVENTION

The present invention relates to improvements in machines for mixing the constituents of and for kneading or similary treating dough for the baking of bread or the like.

German Auslegeschrift No. 1,432,985 discloses a dough making and kneading machine wherein a normally upright cylindrical receptacle has an inlet opening at the top and contains several rotary material agitating, mixing and kneading tools driven at a high speed by a motor which is installed outside of the receptacle. The receptacle is suspended in the machine frame in such a way that it can be pivoted about a horizontal axis in order to allow for evacuation of dough by gravity flow through the aforementioned opening which is located at the top of the drum during mixing, agitating and kneading of the ingredients. The opening can be closed by a cover which is reciprocably guided by horizontal rails mounted in the frame at a level above the drum. The mixing, agitating and kneading tools include a plate-like rotor which is adjacent to the bottom wall of the drum and a large number of minute protuberances randomly distributed on and rotating with the rotor at a speed in the range of 300 RPM. The diameter of the rotor approximates the inner diameter of the drum.

A drawback of the just described machine is its high manufacturing and maintenance cost owing to pivotal mounting of the drum. Moreover, the evacuation of a batch of treated material takes up too much time because each such evacuation must be preceded by tilting of the drum in order to allow the material to issue from the drum through that opening which, in normal upright position of the drum, serves for admission of flour and other ingredients. The material mixing, agitating and kneading tools are not readily accessible and the cleaning of such tools (which exhibit a large number of edges, corners and other material accumulating portions) is a time-consuming operation. The replacement of a first set of tools with a different second set of tools is a cumbersome operation because the tools are mounted in the bottom region of the interior of the drum and are accessible only through the opening at the top.

The just described machine constitutes but one of several presently known dough making and treating machines all or nearly all of which employ an upright receptacle or drum having a material-admitting opening at the top and being tiltable to move the opening to a level at which the treated material can be evacuated by gravity flow. Certain machines employ tools in the form of screws having helical threads and rotating in opposite directions. Certain other machines employ a single screw having threads with a varying pitch, and certain further machines employ tools in the form of twin cones. It was further proposed to rotate the drum in or counter to the direction of rotation of one or more tools therein. All such machines exhibit at least some of the aforediscussed drawbacks, particularly as concerns the down times during evacuation of batches of treated material and/or the accessibility of tools for the purpose of inspection, cleaning and/or replacement. Therefore, such machines failed to find widespread acceptance in production lines for use in bread baking and similar plants because their incorporation into a production line not only reduces the output but necessitates the use of extremely complex, expensive and sensitive programming systems. Also, the aforedescribed machines cannot treat the dough and/or the ingredients of dough in vacuo. Still further, all of the aforedescribed machines utilize prime movers which include a motor and a transmission (such as a V-belt or toothed belt drive) which connects the output shaft of the motor with the shaft or shafts for the tools in the interior of the drum. A drawback of such transmissions is that they necessitate the use of several sets of bearings, e.g., separate bearings for the driving and driven pulleys of a belt transmission.

SUMMARY OF THE INVENTION

An object of the invention is to provided a simple, compact, versatile and rugged machine for the making and treatment of dough or the like.

Another object of the invention is to provide a machine which can be readily incorporated into existing or newly designed proudction lines for mass-production of bread, cakes, cookies and related edible commodities.

A further object of the invention is to provide a machine wherein the position of the receptacle with respect to its frame need not be changed prior to subsequent to admission of fresh ingredients and/or evacuation of batches of treated material.

An additional object of the invention is to provide a machine wherein all such parts which necessitate frequent inspection, cleaning and/or replacement are more readily accessible than in heretofore known machines and wherein the inspection, replacement and/or cleaning takes up less time than in conventional machines.

Still another object of the invention is to provide a novel and improved receptacle for use in machines which are designed for the making, mixing, emulsifying, agitating and kneading of dough or the like.

A further object of the invention is to provide a machine wherein the inlet opening of the receptacle need not be moved relative to the frame for the purpose of admitting fresh ingredients and/or for the purpose of removing a batch of dough.

An additional object of the invention is to provide a machine which is constructed and assembled in such a way that it provides ample room for conveyors, vehicles or other means for automatic evacuation and/or removal of dough.

Another object of the invention is to provide a machine wherein the tool or tools need not be replaced if the machine is to be converted from the making of one type to the making of another type of dough.

The improved machine comprises a receptacle (preferably a horizontal or substantially horizontal drum having a cylindrical main section, a fixed end wall at one end of the main section, and a pivotable end wall at the other end of the main section) which includes an upper portion having a first opening which admits the constituents of dough and a lower portion having a second opening which allows for evacuation of dough, reciprocable gates or analogous means for sealing and exposing the openings in the receptacle, first and second tool means mounted in the receptacle for rotation about discrete first and second axes, and means for rotating the tool means about the respective axes.

One of the tool means is preferably mounted in the pivotable end wall of the receptacle so that its axis of rotation coincides with the axis of the main section. The outer side of the pivotable end wall then carries a discrete motor for one tool means which latter may resemble an L-shaped blade serving to sweep along the inner side of the pivotable end wall and along the internal surface of the main section of the receptacle.

The other tool means is preferably mounted on a shaft driven by a second motor and located below and being parallel to the axis of the main section. Such second tool means can comprise several discrete tools which are spaced apart from and angularly offset with respect to each other and at least one of which preferably urges the contents of the receptacle to move axially and radially of the main section. The L-shaped blade feeds the ingredients of dough into the range of discrete tools to thus promote rapid conversion of ingredients into dough to thereupon promote kneading and homogenization of dough, and to assist in evacuation of dough from the receptacle when the second opening is exposed.

The novel features which are considered as characteristic of the invention are set forth in particular in the appended claims. The improved machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
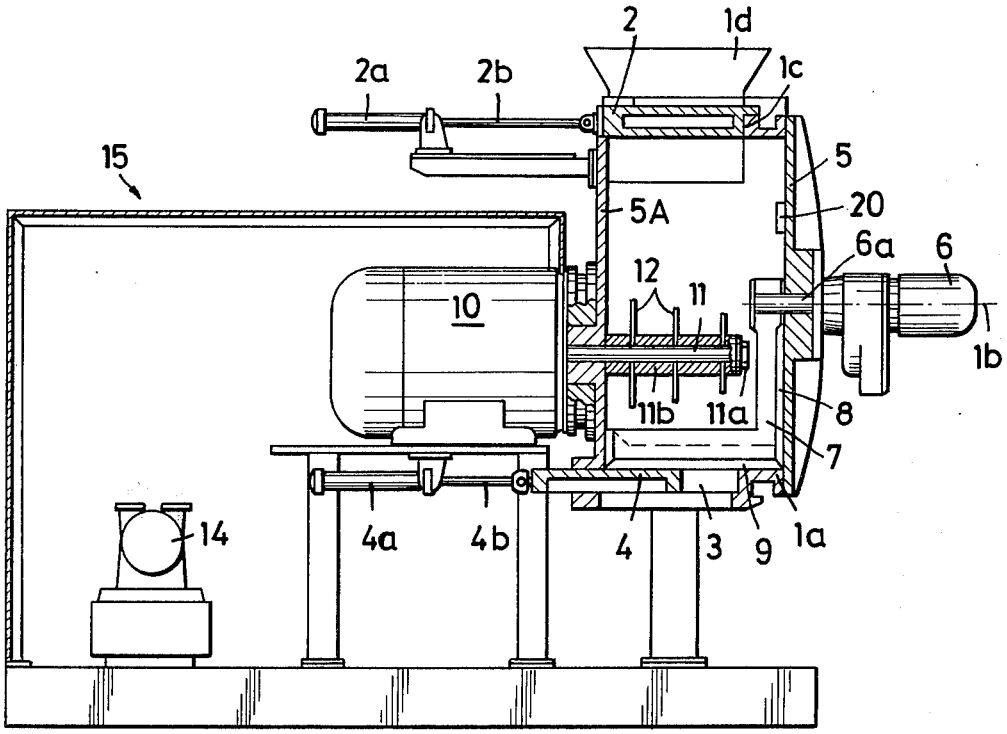
FIG. 1 is a diagrammatic partly elevational and partly vertical sectional view of a machine which embodies the invention.
Figure 2:
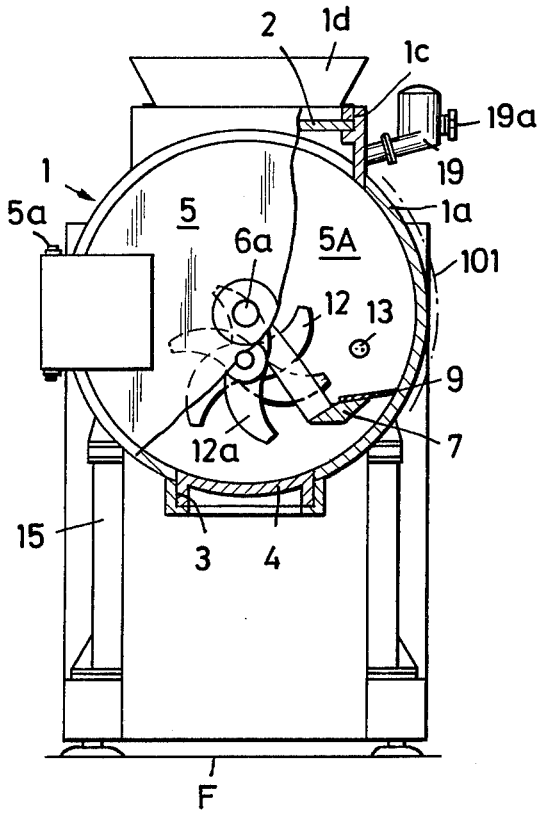
FIG. 2 is an end elevational view as seen from the right-hand side of FIG. 1, with a portion of the receptacle broken away.

The machine which is shown in FIGS. 1 and 2 comprises a frame or housing 15 which supports a substantially horizontal cylindrical receptacle or drum 1 for the material to be treated. One end wall 5 of the drum 1 (which is hermetically sealable during certain stages of operation) constitutes a cover which is articulately connected with the cylindrical main section 1*a* of the drum by a hinge 5*a* so that it can be pivoted between an open position and the closed position which is shown in FIG. 1. The upper part of the main section 1*a* has an inlet opening 1*c* which is sealable by a reciprocable gate 2 disposed below a material-admitting hopper 1*d* and connected to the piston rod 2*b* of a piston in a double-acting hydraulic or pneumatic cylinder 2*a* mounted on the frame 15. The lower portion of the main section 1*a* has an outlet opening 3 sealable by a reciprocable gate 4 which is connected to the piston rod 4*b* of the piston in a second hydraulic or pneumatic double-acting cylinder 4*a* mounted in the frame 15.

The outer side of the cover 5 supports a first prime mover 6 (preferably an electric motor) whose output shaft 6*a* is coaxial with the main section 1*a*, extends through the cover 5 into the interior of the section 1*a* (when the cover 5 is closed) and carries an L-shaped kneading tool 7. The tool 7 has a first edge 8 which extends radially of the shaft 6*a* and can scrape the inner side of the cover 5 when the motor 6 is on as well as a second edge 9 which is parallel to the axis 1*b* and can scrape the cylindrical internal surface of the main section 1*a*.

The machine further comprises a second prime mover 10 (e.g., an electric motor) which is mounted in the frame 15 opposite the cover 5 and has an output shaft 11 extending through the rear end wall 5A of the main section 1*a*, into the interior of the main section, and carries several (e.g., three) coaxial agitating and mixing tools 12 each of which can resemble a three-bladed propeller. The axis of the shaft 11 is parallel to but spaced apart from the axis 1*b* of the main section 1*a*. The sickle-shaped blades 12*a* of each of the tools 12 can be angularly off-set with respect to each other, and these tools can be equally spaced from each other and distributed in the interior of the main section 1*a* in such a way that, when the motor 10 is on, the entire contents of the drum 1 are agitated, kneaded and/or otherwise treated with a high degree of uniformity. The length of each blade 12*a* (as considered in the radial direction of the shaft 11) is preferably (but need not be) the same.

The end wall 5A of the drum 1 has one or more check valves 13 which are connectable with suitable conduits (e.g., pipes or hoses) serving for admission of controlled quantities of pulverulent, gaseous and/or liquid media into the drum, either prior to or during treatment of a batch of kneadable material, e.g., of dough for the baking of bread, cakes, cookies or the like. The valves 13 prevent escape of materials which are confined in the interior of the drum.

The machine further comprises a suction pump 14 or analogous means for reducing the pressure in the interior of the drum 1. As shown in FIG. 1, the outlet opening 3 of the main section 1*a* is mounted at such a level above the floor F that there is room for mounting a pump which withdraws or receives treated material from the section 1*a*, for a conveyor which transports treated material to the next processing station, for one of a series of dollies or other wheel-mounted conveyances for transport of treated material, or for any other means which is to receive material when the gate 4 is moved to its open position. The operation of cylinders 2*a*, 4*a*, motors 6, 10, suction pump 14 and means for admitting the constituents of material to be treated in the drum 1 can be programmed, especially if the machine is built into a production line for mass production of white bread, rye bread, other types of bread, cakes, tarts, cookies, biscuits, muffins and/or others.

Since the entire cover 5 is movable to and from an open position, it can expose the entire front side of the interior of the main section 1*a* so that the tools 12 are fully accessible. The tool 7 is equally accessible so that all tools can be inspected, cleaned and/or replaced with little loss in time. Moreover, conversion of the machine for the making of different types of dough need not even necessitate any addition, replacement or rearrangement of tools; in most instances such adaptation for the making of different types of dough can be achieved by changing the speed of the motor 6 and/or 10. The tool 7 can be secured to the shaft 6*a* by a quick-release coupling, and the tools 12 can be removed upon detachment of a screw 11*a* at the inner end of the shaft 11. The machine can be furnished with several sets of distancing sleeves 11*b* or with a single set of relatively short distancing sleeves which enable the operator to place two, three or more tools 12 at a desired distance from each other, as considered in the axial direction of shaft 11. The tool 7 may be used in combination with one or more similar tools (the tools 7 are then angularly offset with respect to each other), as long as the tools 7 do not interfere with movements of cover 5 to and from closed position.

The operation is as follows:

The dry or relatively dry ingredients (such as flour, salt and/or sugar) are fed into the drum 1 from bins or other suitable sources of supply which discharge metered quantities of the respective ingredients into the hopper 1*d* while the gate 2 is held in the retracted position. Strongly viscous or less viscous liquid ingredients (such as milk, water or cream) can be fed to the hopper by suitable metering devices simultaneously or alternately with liquid-free or substantially liquid-free ingredients. The admission of solid and/or liquid ingredients can take place directly into the hopper 1*d* and/or by way of pipes (one shown at 19) whose discharge ends are connected to the main section 1*a* and which contain suitable shutoff valves 19*a*. For example, the drum 1 can support a discrete pipe 19 for each type of solid and liquid ingredient.

The gate 2 is thereupon returned to the closed position shown in FIG. 1 and the valve or valves 19*a* in the just discussed pipe or pipes 19 are closed to seal the interior of the drum 1 from the atmosphere. The motor 10 is started to rotate the tools 12 at a predetermined speed, for example at a speed within the range of 750 to 1,800 RPM. The motor 6 can be started simultaneously with the motor 10 to rotate the tool 7 at a speed of, for example, 10–60 RPM.

During the initial stage of treatment, the ingredients which are confined in the interior of the drum 1 are subjected to an intensive three-dimensional mixing action. Thus, the blades 12*a* of the tools 12 can be designed in such a way that they feed the ingredients axially of the shaft 11, i.e., toward the cover 5 or toward the end wall 5A of the drum. At the same time, the blades 12*a* move the ingredients radially of the shaft 11. The tool 7 can be driven in or counter to the direction of rotation of the shaft 11; its edge portion 9 pushes the ingredients from the lowermost zone of the space in the drum, along the internal surface of the main section 1*a*, and causes the ingredients to descend into the range of the rotating blades 12*a*. The just described treatment results in thorough intermixing of all ingredients which form a homogeneous mixture within a surprisingly short interval of time. Once the solid ingredients are caused to adhere to each other by liquid ingredients, the pump 14 is started to evacuate air from the interior of the drum 1; such evacuation can take place while the motors 6 and 10 are at a standstill.

The next phase of treatment constitutes a kneading operation. Such kneading operation can be carried out by starting the motor 6 whereby the tool 7 begins to rotate at a relatively low speed (e.g., 10 RPM) to transport the batch of dough-like material along the internal surface of the main section 1*a* so that such batch orbits around the shaft 11 and tools 12. The tools 12 extend into the path of movement of material which is being moved by the tool 7 and effect an intensive kneading action due to the aforementioned tendency of blades 12*a* to move the material axially of the shaft 11 toward the cover 5 or toward the end wall 5A. The speed at which the tools 12 rotate during kneading may but need not be identical with the speed during the initial stage (mixing of ingredients). The tool 7 contributes significantly to an intensive and rapid kneading action in that its two portions repeatedly feed material into the range of rotating tools 12. By properly metering the quantities of ingredients, by properly selecting the speeds of the motors 6, 10 and by properly selecting the configuration, number and dimensions of tools 12, one can insure that the combined mixing and kneading operation will be completed within a predetermined interval of time. If desired, the kneading can be terminated automatically, e.g., by connecting the motors 6, 10 in circuit with a relay which is energized or deenergized by a transducer including an electronic thermometer 20 serving to measure the temperature of dough in the drum 1. It is equally possible to monitor the quantity of energy which is consumed by the motors 6, 10 and to automatically disconnect the motors 6 and 10 from the energy sources when the monitoring means indicates the consumption of a predetermined amount of energy. In its simplest form, the means for automatically terminating a combined mixing and kneading operation may comprise a time-delay device which stops the motors 6, 10 after a preselected interval of operation which has been found to be sufficient to insure absolute homogenization of dough so that the material which is thereupon evacuated via outlet opening 3 is immediately acceptable for treatment at the next station, for example, in a machine or apparatus which separates from dough relatively small batches ready for baking loaves of bread, discrete cakes, cookies, muffins or the like.

The just described treatment can be resorted to for the making of yeast- and wheat-containing dough. When the dough contains white and dark flour (e.g., wheat and rye), the exact moment of transition from the mixing to the kneading stage cannot be pinpointed with the same degree of accuracy as in the making of dough for white bread because a mixture of white and dark flours with other ingredients will not produce a coherent batch or mass. The situation is analogous if the machine is to convert several ingredients into a mass having a consistency similar to that of honey, i.e., the transition from the mixing to kneading and emulsifying stage takes place gradually.

When the last stage of conversion of discrete ingredients into a substance similar to dough is completed, the lower gate 4 is opened, either entirely or in part. The evacuation of dough can be assisted by starting the motor 6 or by not arresting the motor 6 prior to or during opening of the gate 4 so that the tool 7 pushes the dough toward and into the outlet opening 3 by simultaneously scraping material off the inner side of the cover 5 and off the internal surface of the main section 1*a*. It has been found that the tool 7 insures complete or nearly complete evacuation of dough within extremely short intervals of time and thus reduces the periods of idleness of the machine.

The evacuated material can be caused to descend directly into the funnel or hopper of a further machine if such further machine is mounted (or its funnel located) directly below the drum 1. As mentioned above, the opening 3 can also discharge material into discrete conveyances, onto a conveyor (e.g., a belt conveyor or a conveyor which employs a driven feed screw), or into the inlet opening of a pump which causes the material to advance to the next processing station.

The tools which are shown in the drawing can be used with advantage for the making of dough containing wheat, rye, mixtures of wheat and rye, for the making of dough which is used for the baking of pound cakes, for the making of dough which is used for the baking of shortcakes, and many others.

If the improved machine is to be installed in a modern high-speed production line, the frame 15 can be omitted altogether or is replaced with a simple platform. The entire machine then constitutes a single module including the drum 1, motors 6, 10 and gates 2, 4 with means for moving the gates between open and closed positions. The aforementioned platform can support one or more metering devices which supply to the drum flour, salt, sugar, butter and/or other fatty substances, raisins, other types of fruit, milk, water, cream and/or others. The space below the platform can accommodate one or more machines for weighing and metering of the material which is evacuated upon opening of the gate 4.

An important advantage of the improved machine is that the drum 1 need not be tilted or otherwise moved in order to permit for evacuation of dough. Also, and as mentioned above, all tools are readily accessible and the tool 7 contributes to rapid evacuation of dough as well as to cleaning of surfaces which are contacted by dough during mixing and kneading. A further important advantage of the machine is that its essential components occupy little room which is especially important in a production line, e.g., in a bread baking or similar plant.

As shown in FIG. 2, the check valve or valves 13 for admission of liquid and/or gaseous substances are preferably mounted in the lower half of the drum 1.

The improved machine is susceptible of many additional modifications without departing from the spirit of the invention. For example, the main section 1*a*, the cover 5 and/or the end wall 5A can be surrounded by a shell to form therewith one or more passages for the circulation of a heating or cooling medium. This is indicated in FIG. 2 by a phantom-line 101 which is intended to denote the outline of a heating jacket for the main section 1*a*.

Without further analysis, the foregoing will so fully reveal the gist of the present invention that others can, by applying current knowledge, readily adapt it for various applications without omitting features which fairly consitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims.

1. In a machine for making and treating dough or similar substances, a combination comprising a receptacle including a substantially horizontal main section having a substantially cylindrical internal surface and two end walls at the respective axial ends of said main section, one of said end walls being movable to and from an open position to respectively afford and prevent access to the interior of said receptacle, an upper portion having a first opening for admission of the ingredients of said substances and a lower portion having a second opening for evacuation of said substances; means for sealing and exposing said openings; first and second tool means mounted in said receptacle for rotation about discrete first and second axes, one of said tool means being mounted on said one end wall and its axis coinciding with the axis of said main section in the closed position of said one end wall; and means for rotating said tool means about the respective axes.

2. A combination as defined in claim 20, wherein said rotating means comprises a prime mover mounted at the outer side of said one end wall and arranged to rotate said one tool means.

3. A combination as defined in claim 1, wherein said one tool means has a portion which sweeps along the internal surface of said main section when said one tool means is rotated.

4. A combination as defined in claim 1, wherein said one end wall has an inner side and said one tool means has a portion which sweeps along said inner side when said one tool means is rotated.

5. A combination as defined in claim 1, wherein the other of said tool means is rotatable about an axis which is parallel to the axis of said one tool means.

6. A combination as defined in claim 5, wherein said other tool means comprises a plurality of discrete tools spaced apart from each other as considered in the axial direction of said other tool means.

7. A combination as defined in claim 6, wherein said discrete tools are angularly offset with respect to each other.

8. A combination as defined in claim 6, wherein at least one of said discrete tools has portions which urge the contents of said receptacle to move in the axial direction of said main section when said discrete tools are rotated.

9. A combination as defined in claim 5, wherein said rotating means comprises discrete motors for said one and said other tool means.

10. A combination as defined in claim 1, further comprising at least one check valve installed in said receptacle and arranged to permit introduction of flowable ingredients into the interior of said receptacle.

11. A combination as defined in claim 1, further comprising means for maintaining the temperature of at least a portion of said receptacle within a predetermined range.

12. A combination as defined in claim 1, further comprising means for reducing the pressure in said receptacle below atmospheric pressure.

13. A combination as defined in claim 1, wherein said means for rotating said tool means comprises at least one motor; and further comprising means for arresting said motor when the latter consumes a predetermined amount of energy.

14. A combination as defined in claim 1, further comprising means for monitoring the temperature in said receptacle and for arresting said rotating means when the temperature in said receptacle reaches a predetermined value.

15. A combination as defined in claim 1, wherein said rotating means is disposed outside of said receptacle and one of said tool means comprises a device which includes at least one edge portion arranged to sweep an internal surface of said receptacle when said one tool means is driven.

16. A combination as defined in claim 1, wherein said means for sealing and exposing said openings comprises reciprocable gates and motor means for reciprocating said gates.

17. A combination as defined in claim 3, wherein said portion of said one tool means scrapes said internal surface of said main section in said closed position.

18. In a machine for making and treating dough or similar substances, a combination comprising a receptacle including a tubular main section, and two end walls each at one axial end of said tubular main section, at least one of said end walls being mounted on said main section for movement between an open position affording access to the interior of said receptacle, and a closed position preventing such access, said receptacle further including an upper portion having a first opening for admission of the ingredients of said substances and a lower portion having a second opening for evacuation of such substances; means for sealing and exposing said openings; first tool means mounted on said receptacle for rotation about a first axis and extending into said interior thereof; second tool means mounted on said one end wall for joint movement therewith between said open and closed positions and for rotation relative to said receptacle about a second axis at least in said closed position of said one end wall, said second tool means being accommodated in said interior of said receptacle in said closed position of said one end wall; and means for rotating said tool means about the respective axes thereof.

19. A combination as defined in claim 18, wherein said main section is substantially horizontal and has a substantially cylindrical internal surface.

20. A combination as defined in claim 19, wherein one of said tool means is mounted in said one end wall and its axis coincides with the axis of said main section in the closed position of said one end wall.

21. A combination as defined in claim 18, wherein said receptacle is a substantially horizontal drum and one of said tool means is rotatable about an axis which coincides with the axis of said drum, the other of said tool means being rotatable about an axis which is located below and is parallel to the axis of said one tool means.

* * * * *